US009874827B2

(12) United States Patent
Nakamura et al.

(10) Patent No.: US 9,874,827 B2
(45) Date of Patent: Jan. 23, 2018

(54) ELECTROSTATIC CHARGE IMAGE DEVELOPING TONER, ELECTROSTATIC CHARGE IMAGE DEVELOPER, AND TONER CARTRIDGE

(71) Applicant: FUJI XEROX CO., LTD., Tokyo (JP)

(72) Inventors: Yasushige Nakamura, Kanagawa (JP); Shinichi Yaoi, Kanagawa (JP); Asafumi Fujita, Kanagawa (JP); Seijiro Ishimaru, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/218,906

(22) Filed: Jul. 25, 2016

(65) Prior Publication Data

US 2017/0261878 A1 Sep. 14, 2017

(30) Foreign Application Priority Data

Mar. 10, 2016 (JP) ..... 2016-046574

(51) Int. Cl.

| | |
|---|---|
| ***G03G 9/08*** | (2006.01) |
| ***G03G 9/097*** | (2006.01) |
| ***G03G 15/08*** | (2006.01) |
| ***G03G 9/10*** | (2006.01) |

(52) U.S. Cl.
CPC ..... *G03G 9/09758* (2013.01); *G03G 9/0827* (2013.01); *G03G 9/10* (2013.01); *G03G 15/0865* (2013.01)

(58) Field of Classification Search
CPC ..... G03G 9/09758
See application file for complete search history.

(56) References Cited

U.S. PATENT DOCUMENTS

2012/0064453 A1* 3/2012 Farrugia ..... C08J 3/07 430/137.11
2015/0362851 A1* 12/2015 Kihira ..... G03G 9/08755 430/109.4

FOREIGN PATENT DOCUMENTS

JP 2004-126259 A 4/2004
JP 2014-178618 A 9/2014

* cited by examiner

*Primary Examiner* — Mark A Chapman
(74) *Attorney, Agent, or Firm* — Oliff PLC

(57) ABSTRACT

An electrostatic charge image developing toner includes a carbodiimide compound and a polyester resin prepared by subjecting an alcohol component and a carboxylic acid component to condensation polymerization, wherein the alcohol component includes an aliphatic polyol in an amount of 60 mol % to 100 mol %.

9 Claims, 1 Drawing Sheet

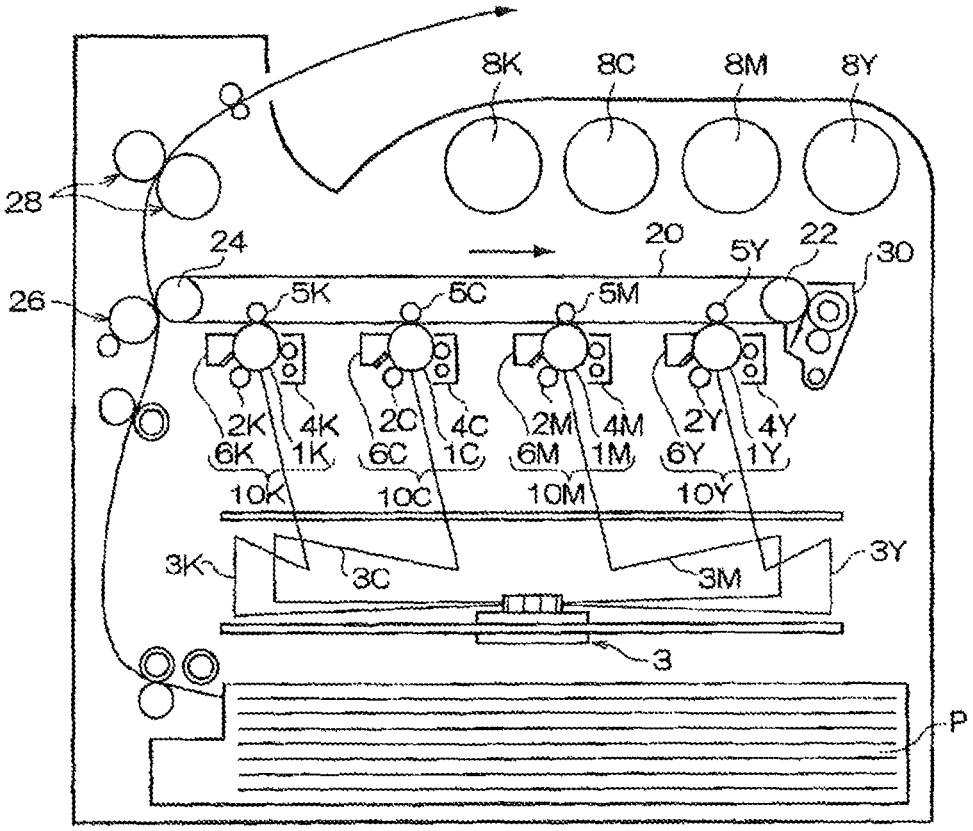
8K
8C
8M
8Y
28
24
20
5Y
22
30
26
5K
5C
5M
2K
4K
2C
4C
2M
4M
2Y
4Y
6K
1K
6C
1C
6M
1M
6Y
1Y
10K
10C
10M
10Y
3K
3C
3M
3Y
3
P

ELECTROSTATIC CHARGE IMAGE DEVELOPING TONER, ELECTROSTATIC CHARGE IMAGE DEVELOPER, AND TONER CARTRIDGE

CROSS-REFERENCE TO RELATED APPLICATIONS

This application is based on and claims priority under 35 USC 119 from Japanese Patent Application No. 2016-046574 filed Mar. 10, 2016.

BACKGROUND

1. Technical Field

The present invention relates to an electrostatic charge image developing toner, an electrostatic charge image developer, and a toner cartridge.

2. Related Art

Methods of visualizing image information through an electrostatic charge image, such as an electrophotography method, are currently used in various fields. With respect to the electrophotography method, an electrostatic charge image (electrostatic latent image) is formed on a photoreceptor (image holding member) by means of charging and exposure processes, and the electrostatic latent image is developed with a developer which includes a toner, and is passed through transfer and fixing processes, so that the image is visualized. A two-component developer formed of a toner and a carrier and a one-component developer using a magnetic toner or a non-magnetic toner independently are known as the developer used herein, and for the preparation of such toners, generally applied is a kneading and pulverizing preparation method in which a thermoplastic resin is molten-kneaded together with a pigment, a charge-controlling agent, and a release agent, such as a wax, and, after cooling, the resultant is finely pulverized and further classified. Inorganic or organic particles for improving the fluidity or cleaning properties may also be added, as necessary, to the surface of the toner particles in such a toner.

SUMMARY

According to an aspect of the invention, there is provided an electrostatic charge image developing toner, including:

a carbodiimide compound; and a polyester resin prepared by subjecting an alcohol component and a carboxylic acid component to condensation polymerization, wherein the alcohol component includes an aliphatic polyol in an amount of 60 mol % to 100 mol %.

BRIEF DESCRIPTION OF THE DRAWING

Exemplary embodiments of the present invention will be described in detail based on the following figures, wherein:

The FIGURE is a schematic configuration diagram illustrating an example of an image forming apparatus suitably used in an exemplary embodiment.

DETAILED DESCRIPTION

Below, exemplary embodiments of the invention will be described.

In the following description, description of "A to B" representing a numerical range is synonymous with "from A to B" unless otherwise noted, and signifies a numerical range which includes A and B which are the end points.

(1) Electrostatic Charge Image Developing Toner

The electrostatic charge image developing toner according to the exemplary embodiment (also referred to simply as "toner") contains a carbodiimide compound and a polyester resin prepared by subjecting an alcohol component and a carboxylic acid component to condensation polymerization, provided that the alcohol component contains an aliphatic polyol in an amount of 60 mol % to 100 mol %.

As a result of detailed investigations by the present inventors, the following is found. In the case where a polyester resin including an aliphatic alcohol component in a large amount as the alcohol component is used in the toner, the fixability is favorable because the resin is soft, but, during continuous printing in a strict low temperature and low humidity environment (0° C., 0% RH to 5% RH) as the client usage environment, a charging up of the toner with a negative charge (absolute value of the negative charge amount rises) rapidly occurs, the density lowers, and, thereafter, the changes in the printing density increase due to the rise in density caused by a lowering of the charge with a lapse of time.

Therefore, in order to prevent the sudden charging up, the present inventors found, as a result of performing thorough research, an electrostatic charge image developing toner with superior fixability and density stability during continuous printing in a low temperature and low humidity environment is obtained by adding a carbodiimide compound to the toner.

Although the details of the mechanism by which the effect is exhibited is unclear, in the electrostatic charge image developing toner, it is assumed that a portion of the carbodiimide compound is substituted for a carboxyl group which is easily negatively charged on the terminal of the polyester resin in a skeleton having nitrogen atoms which are not easily negatively charged, the charging up of the negative charge is prevented, the density stability during continuous printing in a low temperature and low humidity environment is superior, and there is no influence on the fixability.

<Carbodiimide Compound>

The electrostatic charge image developing toner according to the exemplary embodiment contains a carbodiimide compound.

The term "carbodiimide compound" refers to a compound having one or more —N═C═N— structure.

Although the carbodiimide compound may be a linear carbodiimide compound or may be a cyclic carbodiimide compound, a cyclic carbodiimide compound is preferable from the viewpoint of density stability during continuous printing in a low temperature and low humidity environment.

Although the carbodiimide compound may be a monofunctional carbodiimide compound or may be a polyfunctional carbodiimide compound, from the viewpoint of fixability and density stability during continuous printing in a low temperature and low humidity environment, a monofunctional carbodiimide compound or a bifunctional carbodiimide compound is preferable, and particularly preferably a monofunctional carbodiimide compound.

It is preferable that the carbodiimide compound be a compound having one or more aromatic rings, and more preferably a compound with two or more aromatic rings.

It is preferable that the carbodiimide compound be a compound in which each of the aromatic rings is bonded to two nitrogen atoms of the —N═C═N— structure.

Examples of the linear carbodiimide compound include N,N'-di-2,6-diisopropylphenyl carbodiimide, N,N'-di-o-tolyl carbodiimide, N,N'-diphenyl carbodiimide, N,N'-di octyldecyl carbodiimide, N,N'-di-2,6-dimethylphenyl carbodiimide, N-tolyl-N'-cyclohexyl carbodiimide, N,N'-di-2,6-di-tert-butyl phenyl carbodiimide, N-tolyl-N'-phenyl carbodiimide, N,N'-di-p-nitrophenyl carbodiimide, N,N'-di-p-amino phenyl carbodiimide, N,N'-di-p-hydroxyphenyl carbodiimide, N,N'-dicyclohexyl carbodiimide, N,N'-di-p-tolyl carbodiimide, p-phenylene bis di-o-tolyl carbodiimide, p-phenylene bisdicyclohexyl carbodiimide, hexamethylene bisdicyclohexyl carbodiimide, ethylene-bis-diphenyl carbodiimide, N,N'-benzyl carbodiimide, N-octadecyl-N'-phenyl carbodiimide, N-benzyl-N'-phenyl carbodiimide, N-octadecyl-N'-tolyl carbodiimide, N-cyclohexyl-N'-tolyl carbodiimide, N-phenyl-N'-tolyl carbodiimide, N-benzyl-N'-tolyl carbodiimide, N,N'-di-o-ethylphenyl carbodiimide, N,N'-di-p-ethylphenyl carbodiimide, N,N'-di-o-isopropyl phenyl carbodiimide, N,N'-di-p-isopropyl phenyl carbodiimide, N,N'-di-o-isobutylphenyl carbodiimides, N,N'-di-p-isobutylphenyl carbodiimides, N,N'-di-2,6-diethylphenyl carbodiimide, N,N'-di-2-ethyl-6-isopropyl phenyl carbodiimide, N,N'-di-2-isobutyl-6-isopropyl phenyl carbodiimide, N,N'-di-2,4,6-trimethylphenyl carbodiimides, N,N'-di-2,4,6-triisopropyl phenyl carbodiimide, N,N'-di-2,4,6-triisobutyl phenyl carbodiimide, diisopropyl carbodiimide, dimethyl carbodiimide, diisobutyl carbodiimide, dioctyl carbodiimide, t-butyl isopropyl carbodiimide, di-β-naphthyl carbodiimide, di-t-butyl carbodiimide, and the like.

Preferable examples of the cyclic carbodiimide compound include compounds having a ring which includes a carbodiimide group as a member, and more preferably the example compound represented by the following formula (A).

(A)

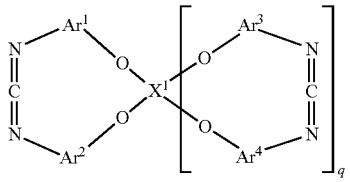

In the formula (A), $X^1$ represents a bivalent or tetravalent group, $Ar^1$ to $Ar^4$ each independently represent a bivalent aromatic group, and q represents 0 or 1.

It is preferable that $Ar^1$ to $Ar^4$ are each independently a bivalent aromatic group with 5 to 15 carbon atoms, such as a phenylene group and a naphthalenediyl group, more preferably an o-phenylene group or an m-phenylene group, and particularly preferably an o-phenylene group.

The bivalent aromatic group may be substituted by a substituent. It is possible to apply a well-known substituent as the substituent, and examples thereof include an alkyl group, an aryl group, a cycloalkyl group, an alkoxy group, a hydroxy group, an aldehyde group, a acyl group, a carboxyl group, an alcyloxy group, a nitro group, an amino group, a sulfo group, a sulfonyloxy group, a halogen group, a silyl group, a vinyl group, an allyl group, a cyano group, an isonitryl group, an amide group, an imide group, and a mercapto group. The substituent may also be another polymer or a linking group with a cyclic carbodiimide compound.

It is preferable that q be 0.

It is preferable that $X^1$ be a bivalent or quadrivalent hydrocarbon group, and preferably a bivalent or quadrivalent group with 2 to 30 carbon atoms.

It is preferable that $X^1$ be a group represented by the following formulae (A-1) to (A-6), more preferably a group represented by the following formulae (A-1) to (A-5), and particularly preferably a group represented by the following formula (A-1) or formula (A-2).

It is preferable that $X^1$ be a bivalent group.

(A-1)

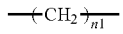

(A-2)

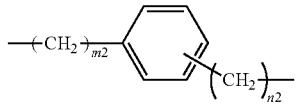

(A-3)

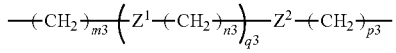

(A-4)

(A-5)

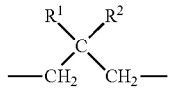

(A-6)

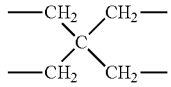

In the formulae (A-1) to (A-5), $Z^1$ and $Z^2$ each independently represent an oxygen atom or a sulfur atom, $Ar^5$ represents a bivalent aromatic group, $R^1$ and $R^2$ each independently represent an alkyl group or a phenyl group with 1 to 6 carbon atoms, n1 represents an integer of 1 to 6, m2 and n2 each independently represent an integer of 0 to 3, m3, n3, and q3 each independently represent an integer of 1 to 4, q3 represents an integer of 0 to 3, and m4 and n4 each independently represent an integer of 1 to 3.

In the formula (A-1), it is preferable that n1 be an integer of 2 to 6, more preferably an integer of 2 to 4, and particularly preferably 2.

In the formula (A-2), it is preferable that m2 and n2 independently represent an integer of 1 to 3, and more preferably 1.

Although the bonding location of the two groups on the benzene ring in the formula (A-2) may be any of the ortho position, the meta position, and the para position, the para position is preferable.

In the formula (A-3), it is preferable that $Z^1$ and $Z^2$ be oxygen atoms.

In the formula (A-3), it is preferable that m3, n3, and q3 each independently represent an integer of 2 to 4, and is more preferably 2.

Furthermore, in the formula (A-3), it is preferable that the q3 be 0 or 1, and more preferably 0.

In the formula (A-4), it is preferable that $Ar^5$ be a bivalent aromatic group with 5 to 15 carbon atoms, more preferably a phenylene group, and particularly preferably an m-phenylene group.

In the formula (A-4), it is preferable that m4 and n4 each independently represent an integer of 2 or 3, and more preferably 2.

Examples of the alkyl group with 1 to 6 carbon atoms in $R^1$ and $R^2$ in the formula (A-5) include a methyl group, an ethyl group, a n-propyl group, a sec-propyl group, an iso-propyl group, a n-butyl group, a tert-butyl group, a sec-butyl group, an iso-butyl group, a n-pentyl group, a sec-pentyl group, an iso-pentyl group, a n-hexyl group, a sec-hexyl group, and an iso-hexyl group.

Particularly preferable examples of the cyclic carbodiimide compound include the compound represented by formula (1).

(1)

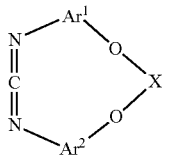

In the formula (1), X represents a bivalent group, $Ar^1$ and $Ar^2$ each independently represent a bivalent aromatic group.

$Ar^1$ and $Ar^2$ in the formula (1) have the same meaning as $Ar^1$ and $Ar^2$ in formula (A), and the preferable ranges are also the same.

In the formula (1), it is preferable that X be a group represented by the formulae (A-1) to (A-5), more preferably a group represented by the formulae (A-1) to (A-2), and particularly preferably a group represented by the following formula (2).

It is preferable that X be a bivalent group having 2 to 20 carbon atoms, and more preferably a bivalent hydrocarbon group having 2 to 20 carbon atoms.

(2)

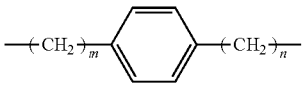

In the formula (2), m and n each independently represent an integer of 0 to 3, an integer of 1 to 3 is preferable, and more preferably 1.

Specific suitable examples of the cyclic carbodiimide compound include the compounds illustrated below.

In the following compounds, each $L^1$ independently represents a single bond or an alkylene group having 1 to 3 carbon atoms, each $L^2$ independently represents an alkylene group having 2 to 6 carbon atoms, each $L^3$ independently represents an alkylene group having 2 to 4 carbon atoms, and each $L^4$ independently represents an alkyl group having 1 to 6 carbon atoms.

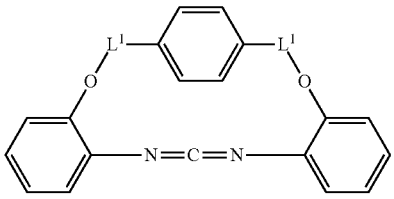

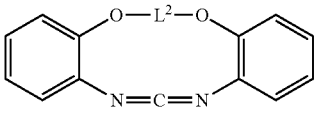

-continued

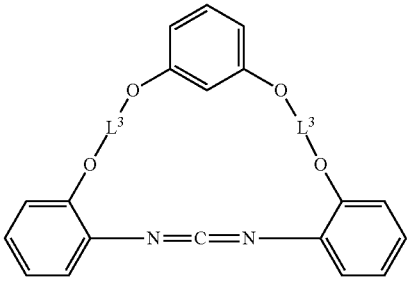

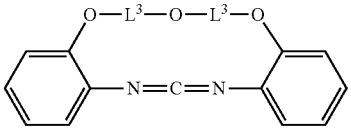

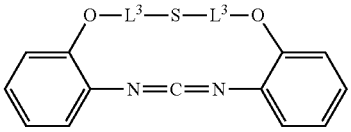

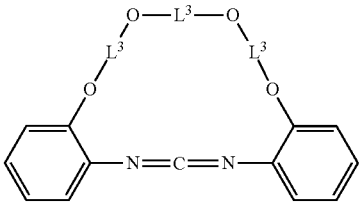

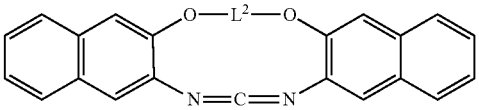

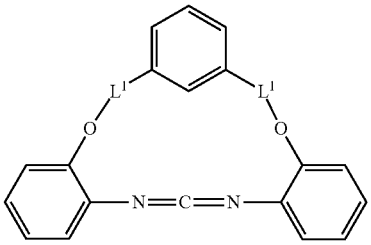

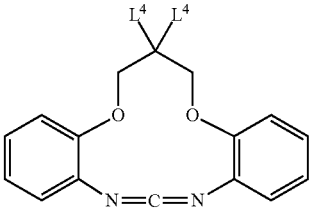

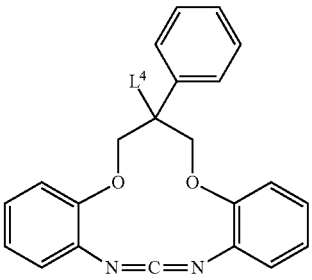

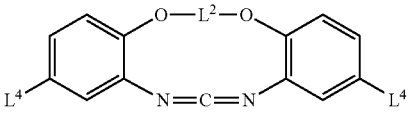

-continued

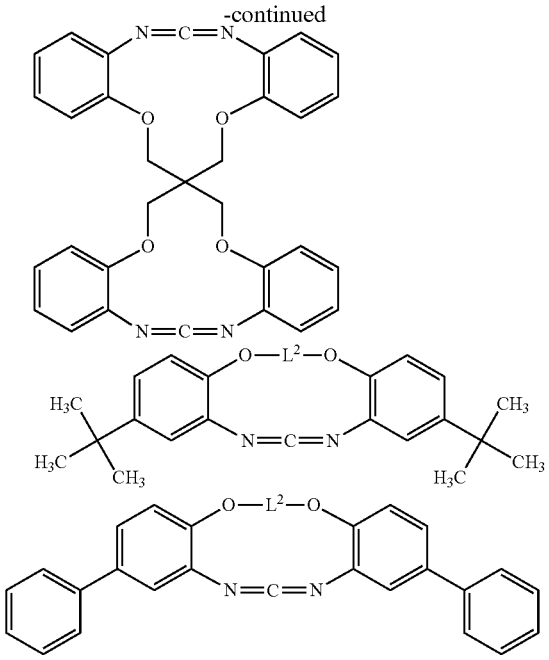

The carbodiimide compound may contain a single independent type, or may contain two or more types.

It is preferable that the content of the carbodiimide compound be 0.01 parts by weight to 15 parts by weight with respect to 100 parts by weight of the polyester resin contained in the toner, more preferably 0.02 parts by weight to 10 parts by weight, and particularly preferably 0.1 parts by weight to 5 parts by weight. When within the above-described range, the fixability and density stability during continuous printing in a low temperature and low humidity environment are superior.

<Polyester Resin>

The electrostatic charge image developing toner according to the exemplary embodiment contains a polyester resin in which an alcohol component and a carboxylic acid component are subjected to condensation polymerization, and 60 mol % to 100 mol % from the alcohol component is an aliphatic polyol.

In the electrostatic charge image developing toner according to the exemplary embodiment, it is preferable that the polyester resin contain a binder resin.

It is preferable that the polyester resin be a polyester resin in which a diol compound, a dicarboxylic acid, and a tricarboxylic acid are subjected to condensation polymerization, and a polyester resin in which an aliphatic diol compound, a dicarboxylic acid, and more preferably a tricarboxylic acid are subjected to condensation polymerization.

60 mol % to 100 mol % of the alcohol component in the polyester resin is an aliphatic polyol, it is preferable that 70 mol % to 100 mol % be an aliphatic polyol, it is more preferable that 80 mol % to 100 mol % be an aliphatic polyol, and it is particularly preferable that 100 mol % be an aliphatic polyol. When the above aspect is carried out, the fixability is superior.

It is preferable that the aliphatic polyol be an aliphatic polyol having 2 to 8 carbon atoms, from the viewpoint of durability, and more preferably an aliphatic polyol having 2 to 6 carbon atoms.

Examples of the aliphatic polyol include diols such as ethylene glycol, 1,2-propylene glycol, 1,3-propylene glycol, 1,4-butanediol, 1,5-pentanediol, 1,6-hexanediol, neopentyl glycol, 1,4-butenediol, 1,7-heptanediol, and 1,8-octanediol, and trivalent or higher polyols such as glycerin, pentaerythritol, and trimethylolpropane. Among these, α, ω-linear alkanediol is preferable, and particularly preferably ethylene glycol and/or propylene glycol.

A polyol component other than the aliphatic polyol may be contained in the alcohol component, and examples thereof include bivalent aromatic alcohols such as alkylene (2 to 3 carbon atoms) oxide (1 to 10 average added mol) adducts of bisphenol A.

It is preferable that the polyester resin include a monomer unit represented by the following formula (3) as the aliphatic polyol-derived monomer unit.

$$\text{+O—}R^{al}\text{—O+} \qquad (3)$$

In the formula (3), $R^{al}$ represents an alkylene group having 2 to 8 carbon atoms.

The alkylene group in $R^{al}$ may be a linear alkylene group or may be a branched alkylene group.

In the formula (3), it is preferable that $R^{al}$ be an alkylene group having 2 to 4 carbon atoms, and more preferably an alkylene group having 2 or 3 carbon atoms.

It is preferable that the polyester resin include 15% by weight to 70% by weight of a monomer unit represented by the formula (3) with respect to the total weight of the polyester resin, more preferably including 20% by weight to 65% by weight, and still more preferably 30% by weight to 60% by weight.

Examples of the carboxylic acid component include aromatic polyvalent carboxylic acids, such as phthalic acid, isophthalic acid, terephthalic acid, trimellitic acid, and pyromellitic acid; aliphatic polyvalent carboxylic acids such as succinic acid substituted having alkyl groups having 1 to 20 carbon atoms such as fumaric acid, maleic acid, adipic acid, succinic acid, dodecenyl succinic acid, and octenyl succinic acid, or alkenyl groups having 2 to 20 carbon atoms; anhydrides of these acids, and alkyl (1 to 8 carbon atoms) esters of these acids.

Among these, a dicarboxylic acid compound and a tricarboxylic acid compound are preferable, and more preferably a terephthalic acid and a trimellitic acid. It is preferable that the usage rate of the dicarboxylic acid compound and the tricarboxylic acid compound be dicarboxylic acid compound:tricarboxylic acid compound=2:1 to 50:1 in terms of mole ratio, and more preferably 3:1 to 10:1.

It is preferable that the carboxylic acid component include an aromatic polyvalent carboxylic acid compound from the viewpoint of chargeability.

It is preferable that the content of the aromatic polyvalent carboxylic acid compound be 30 mol % to 100 mol % of the carboxylic acid component, and more preferably 50 mol % to 100 mol %.

From the viewpoint of fixability, it is preferable to include a trivalent or higher polyol compound and/or a trivalent or higher polyvalent carboxylic acid compound as the alcohol component and/or the carboxylic acid component.

It is preferable that the content of the trivalent or higher polyol compound and/or the trivalent or higher polyvalent carboxylic acid compound be 0.1 mol % to 20 mol % in the alcohol component and the carboxylic acid component, and more preferably 1 mol % to 15 mol %.

It is preferable that the acid value of the polyester resin be 5 mgKOH/g to 70 mgKOH/g.

It is preferable that the weight average molecular weight Mw of the polyester resin be 5,000 to 40,000, and more preferably 10,000 to 30,000.

The polyester resin may contain a single independent type, or may contain two or more types.

It is preferable that the content of the polyester resin in the electrostatic charge image developing toner according to the exemplary embodiment be 50% by weight to 99% by weight with respect to the total weight of the toner, more preferably 60% by weight to 97% by weight, and particularly preferably 70% by weight to 95% by weight.

<Release Agent>

It is preferable that the electrostatic charge image developing toner according to the exemplary embodiment contain a release agent.

Examples of the release agent include hydrocarbon waxes; natural waxes such as carnauba wax, rice wax, and candelilla wax; synthetic or mineral and petroleum waxes, such as montan wax, and ester waxes such as fatty acid esters and montanic acid esters. The release agent is not limited thereto.

Among these, it is preferable that the release agent be a hydrocarbon wax (wax having a hydrocarbon as a skeleton), and more preferably a paraffin wax. Because hydrocarbon waxes easily forma release agent domain and easily seeps out quickly on the surface of the toner (toner particles) during fixing, a hydrocarbon wax is favorable.

The release agent may contain a single independent type, or may contain two or more types.

It is preferable that the content of the release agent in the toner be 1.0% by weight to 20% by weight, and more preferably 5.0% by weight to 15% by weight.

<Colorant>

It is preferable that the electrostatic charge image developing toner according to the exemplary embodiment contain a colorant.

Although the colorant may be a dye or may be a pigment, a pigment is used from the viewpoint of light fastness and waterproofness. The colorant is not limited to a colored colorant and also includes a white colorant or a colorant having a metallic color.

Known pigments, such as carbon black, aniline black, aniline blue, calico oil blue, chrome yellow, ultramarine blue, DUPONT OIL RED, quinoline yellow, methylene blue chloride, phthalocyanine blue, malachite green oxide, lamp black, rose bengal, quinacridone, benzidine yellow, C.I. PIGMENT RED 48:1, C.I. PIGMENT RED 57:1, C.I. PIGMENT RED 122, C.I. PIGMENT RED 185, C.I. PIGMENT RED 238, C.I. PIGMENT YELLOW 12, C.I. PIGMENT YELLOW 17, C.I. PIGMENT YELLOW 180, C.I. PIGMENT YELLOW 97, C.I. PIGMENT YELLOW 74, C.I. PIGMENT BLUE 15:1, and C.I. PIGMENT BLUE 15:3 are used as the colorant.

It is preferable that the content of the colorant in the electrostatic charge image developing toner according to the exemplary embodiment be 1 part by weight to 30 parts by weight with respect to 100 parts by weight of the binder resin.

Using a surface treated colorant and using pigment dispersant are also effective. A yellow toner, a magenta toner, a cyan toner, a black toner and the like are prepared by selecting the type of colorant.

<Other Binder Resin>

Although the electrostatic charge image developing toner according to the exemplary embodiment may include a binder resin (other binder resin) other than the polyester resin, it is preferable to not contain another resin.

In a case of including a binder resin other than the polyester resin, the content thereof is less than the content of the polyester resin, is preferably 10% by weight or less with respect to the total weight of the toner, more preferably 5% by weight or less, and particularly preferably not including the other binder resin.

The other binder resin is not particularly limited, and examples thereof include homopolymers formed of monomers such as styrenes, such as styrene, parachloro styrene, α-methyl styrene; esters having a vinyl group, such as methyl acrylate, ethyl acrylate, n-propyl acrylate, n-butyl acrylate, lauryl acrylate, 2-ethylhexyl acrylate, methyl methacrylate, ethyl methacrylate, n-propyl methacrylate, lauryl methacrylate, and 2-ethylhexyl methacrylate; vinyl nitriles, such as acrylonitrile and methacrylonitrile; vinyl ethers, such as vinyl methyl ether and vinyl isobutyl ether; vinyl ketones, such as vinyl methyl ketone, vinyl ethyl ketone, and vinyl isopropanyl ketone; and polyolefins, such as ethylene, propylene, and butadiene, or copolymers obtained by combining two or more types thereof, and further mixtures thereof. Examples include epoxy resins, polyester resins other than the polyester resin, polyurethane resins, polyamide resins, cellulose resins, polyether resins, and the like, and non-vinyl condensed resins, or mixtures thereof with a vinyl resin, or graft polymers and the like obtained by polymerizing vinyl monomers in the presence thereof.

The styrene resin, (meth) acrylic resin, and styrene-(meth) acrylic copolymer resin are obtained by combining the styrene monomer and the (meth) acrylate monomer independently or as appropriate using a known method. It should be noted that the expression "(meth) acryl" includes either of "acryl" or "methacryl".

In a case of using a styrene resin, a (meth) acrylic resin and a copolymer resin thereof as the binder resin, it is preferable to use a resin having a weight average molecular weight Mw of from 20,000 to 100,000 and a number average molecular weight Mn in a range of from 2,000 to 30,000.

—Other Additives—

Various components such as internal additives and charge-controlling agents other than the above-described components may be further added, as necessary, to the electrostatic charge image developing toner according to the exemplary embodiment.

Examples of the internal additive include magnetic materials including metals and alloys, such as ferrite, magnetite, reduced iron, cobalt, nickel, and manganese, or compounds including these metals.

Examples of the charge-controlling agent include pigments formed of complexes such as quaternary ammonium salt compounds, nigrosine compounds, alumina, iron and chromium, triphenyl methane pigments and the like.

<External Additive>

It is preferable that the electrostatic charge image developing toner according to the exemplary embodiment contain an external additive.

The material of the external additive is not particularly limited, and although known inorganic particles and organic particles are used as the other additives in the toner, examples thereof include inorganic particles such as silica, alumina, titanium oxide compounds (such as titanium oxide and metatitanic acid), cerium oxide, zirconia, calcium carbonate, magnesium carbonate, calcium phosphate, and carbon black, and resin particles such as vinyl resins, polyester resins, and silicone resin. Among these, it is particularly preferable that the external additive be silica particles.

Examples of the silica particles include silica particles such as fumed silica, colloidal silica, and silica gel, and the silica particles are used without particular limitation.

The external additive may be treated with a hydrophobizing agent such as a silane coupling agent, described later.

The treatment with a hydrophobizing agent may be performed by immersion of the particles in the hydrophobizing agent or the like. Although the hydrophobizing agent is not particularly limited, examples thereof include silane coupling agents, titanate coupling agents, and aluminum coupling agents. These may be used as one type independently or in combination of two or more types. Among these, the silane coupling agent is a favorable example.

It is also possible to use any type of chlorosilane, alkoxysilane, silazane, a special silylating agent as the silane coupling agent.

Specific examples include methyl trichlorosilane, dimethyl dichlorosilane, trimethyl chlorosilane, phenyl trichlorosilane, diphenyl dichlorosilane, tetramethoxysilane, methyl trimethoxysilane, dimethyl dimethoxysilane, phenyl trimethoxysilane, diphenyl dimethoxysilane, tetraethoxysilane, methyl triethoxysilane, dimethyl diethoxysilane, phenyl triethoxysilane, diphenyl diethoxysilane, isobutyl triethoxysilane, decyl trimethoxysilane, hexamethyl disilazane, N,O-(bis trimethylsilyl) acetamide, N,N-(trimethylsilyl) urea, tert-butyldimethyl chlorosilane, vinyl trichlorosilane, vinyl trimethoxysilane, vinyl triethoxysilane, γ-methacryloxypropyl trimethoxysilane, β-(3,4-epoxycyclohexyl) ethyl trimethoxysilane, γ-glycidoxypropyl trimethoxysilane, γ-glycidoxypropylmethyl diethoxysilane, γ-mercaptopropyltrimethoxysilane, and γ-chloropropyl trimethoxysilane.

Although the amount of the hydrophobizing agent may not be unconditionally stipulated according to the type of particles, 1 part by weight to 50 parts by weight with respect to 100 parts by weight of the particles is preferable, and more preferably 5 parts by weight to 20 parts by weight. In the exemplary embodiment, commercially available products are also favorably used as the hydrophobic silica particle treated with a hydrophobizing agent.

It is preferable that the primary average particle diameter of the external additive be 1 nm to 500 nm, more preferably 5 nm to 300 nm, still more preferably 10 nm to 200 nm, and particularly preferably 10 nm to 50 nm.

It is preferable that the addition amount of the external additive be in a range of 0.1 parts by weight to 5 parts by weight with respect to 100 parts by weight of the toner, and more preferably a range of 0.3 parts by weight to 2 parts by weight. When the addition amount is 0.1 parts by weight or more, the fluidity of the toner is moderate, the chargeability superior, and the charge exchangeability is superior. Meanwhile, when the addition amount is 5 parts by weight or less, the state of coverage is moderate, it is possible to prevent the external additive from migrating to the contact member, and the occurrence of secondary damage is prevented.

<Toner Characteristics>

It is preferable that the volume average particle diameter of the electrostatic charge image developing toner according to the exemplary embodiment be 2 μm to 9 μm, and more preferably 3.0 μm to 7.0 μm. When the value is within the above-described range, the effects of the exemplary embodiment are better exhibited.

It is preferable that measurement of the volume average particle diameter of the toner be performed using a COULTER MULTISIZER-II (manufactured by BECKMAN-COULTER, INC.) and to use ISOTON-II (manufactured by BECKMAN-COULTER, INC.) as the electrolytic solution.

Examples of the measurement method specifically include the following methods.

A 1.0 mg of a measurement sample is added to 2 ml of a surfactant, preferably a 5% aqueous solution of sodium alkylbenzene sulfonate as a dispersant. The resultant is added to 100 ml of the electrolytic solution, thereby preparing an electrolytic solution in which the sample is suspended. The electrolytic solution in which the sample is suspended is subjected to a dispersion treatment for one minute with an ultrasonic disperser, and the volume average distribution and the number average distribution are calculated using a COULTER MULTISIZER II by measuring the size distribution of 1 μm to 30 μm particles using a 50 μm aperture as the aperture diameter. It should be noted that the number of particles measured is 50,000.

It is preferable that size distribution of the electrostatic charge image developing toner according to the exemplary embodiment be narrow, more specifically, it is preferable that (GSDv) in which the ratio of 16% diameter ($D_{16v}$) and the 84% diameter ($D_{84v}$) converted from the smallest volumetric particle diameter of the toner, that is GSDv represented by the following equation be 1.21 or less, more preferably 1.19 or less, and particularly preferably 1.17 or less.

$$GSDv=[(D_{84v})/(D_{16v})]^{0.5} \quad (1)$$

(In equation (1), $D_{84v}$ and $D_{16v}$ are accumulated 84% and 16% particle diameters when a volume cumulative distribution curve is drawn from the small particle diameter size with respect to the respective divided particle size ranges.)

When GSDv is within the above-described range, because the formation of particles in which the toner charge amount becomes excessively large is prevented, a worsening of the fine line reproducibility of combination colors is further prevented.

It is preferable that the shape coefficient SF1 of the electrostatic charge image developing toner according to the exemplary embodiment is within a range of from 110 to 140, and more preferably a range of from 110 to 130. The transfer efficiency and the compactness of the image are improved by the shape being in the range of a sphere, and a high quality image is formed.

Here, the shape coefficient SF1 is obtained through the following equation (E).

$$SF1=(ML^2/A)\times(\pi/4)\times100 \quad \text{Equation (E)}$$

In the above-described equation (E), ML indicates the absolute maximum length of the toner and A indicates the projected area of the toner.

SF1 is converted to numerical values mainly by analyzing microscope image or a scanning electron microscope (SEM) image using an image analyzer, and for example, it is possible to calculate SF1 as follows. That is, the SF1 is obtained by loading an optical microscope image of particles dispersed on the surface of a glass slide in a LUZEX image analyzer through a video camera, obtaining the maximum length and projected area of 100 particles, performing calculation with the above equation (E), and obtaining the average value thereof.

<Method of Preparing Toner>

The preparing method of the electrostatic charge image developing toner according to the exemplary embodiment is not particularly limited, and preparation is carried out by a dry method, such as a known kneading and pulverizing method, a wet method such as an emulsion aggregating method and a suspension polymerization method or the like. Among these methods, a kneading and pulverizing method and an emulsion aggregating method are preferable.

(2) Electrostatic Charge Image Developer

The electrostatic charge image developing toner according to the exemplary embodiment is favorably used as an electrostatic charge image developer.

The electrostatic charge image developer according to the exemplary embodiment is not particularly limited other than containing the electrostatic charge image developing toner according to the exemplary embodiment, and may take an appropriate component composition, according to the purpose. The electrostatic charge image developing toner according to the exemplary embodiment is prepared as a one component based electrostatic charge image developer when used independently, and prepared as a two component electrostatic charge image developer when used combined with a carrier.

A method of frictionally charging the one component developer with a developing sleeve or a charging member, forming a charged toner, and developing in response to the electrostatic latent image is also applied.

Although the developing method is not particularly stipulated in the exemplary embodiment, a two component developing method is preferable, and it is preferable that the electrostatic charge image developer according to the exemplary embodiment contain a carrier.

Although the carrier is not particularly limited, core of the carrier include magnetic metals such as iron, steel, nickel and cobalt, alloys of these with manganese, chromium, rare earths and the like, and magnetic oxides such as ferrite and magnetite, and preferable examples, from the viewpoint of core surface properties and core resistance, include ferrite, in particular, alloys with manganese, lithium, strontium, and magnesium.

It is preferable that the carrier used in the exemplary embodiment be a carrier in which the core surface is coated by a resin. The resin is selected, as appropriate, according to the purpose without particular limitation. It is preferable that resin particles and/or conductive particles be dispersed in the resin for the coating film using the resin. Examples of the resin particles include thermoplastic resin particles and thermoplastic resin particles.

Although not particularly limited, methods of forming the coating film include methods using a solution for forming a coating film which includes resin particles such as cross-linking resin particles and/or conductive particles, and the resin, such as styrene acrylic resin, fluororesin, and silicone resin as the matrix resin in a solvent.

Specifically, examples include an immersion method of immersing the carrier core in a solution for forming a coating film, a spray method which sprays the solution for forming a coating film on the surface of the carrier core, and a kneader coater method which mixes the solution for forming a coating film in a state in which the carrier core is made to float freely by means of floating air, and removes the solvent. Among these, a kneader coater method is preferable in the exemplary embodiment.

It is preferable that average particle diameter of the carrier and core be from 10 μm to 100 μm, and more preferably from 20 μm to 80 μm The mixing proportions of the toner to the carrier in the electrostatic charge image developer according to the exemplary embodiment are preferably 1 part by weight to 30 parts by weight of toner with respect to 100 parts by weight of the carrier, and more preferably 3 parts by weight to 20 parts by weight of the toner. Although not particularly limited, examples of the preparation method of the electrostatic charge image developer include a method of mixing with a V blender or the like.

(3) Image Forming Method

The electrostatic charge image developing toner according to the exemplary embodiment is used in an electrostatic charge image developing (electrophotography method) image forming method.

As long as the image forming method according to the exemplary embodiment is an image forming method which uses the electrostatic charge image developing toner according to the exemplary embodiment, it is preferable that the method include a latent image forming step of forming an electrostatic latent image on the surface of image holding member, a developing step of developing the electrostatic latent image formed on the surface of the image holding member with a developer which includes a toner and forming a toner image; a transferring step of transferring the toner image on the surface of a transfer medium, a fixing step of fixing the toner image on the surface of the transfer medium, and which uses either the electrostatic charge image developing toner according to the exemplary embodiment as the toner or uses the electrostatic charge image developer according to the exemplary embodiment as the developer.

Each step is itself a general step. It is possible to carry out the image forming method according to the exemplary embodiment using an image forming apparatus such as a copying machine and a facsimile machine, which are well known.

The electrostatic latent image forming step is a step of forming an electrostatic latent image on the image holding member (photoreceptor).

The developing step is a step of developing the electrostatic latent image using a developer layer on a developer holding member and forming a toner image. As long as the developer includes the electrostatic charge image developing toner according to the exemplary embodiment, the developer layer is not particularly limited.

The transferring step is a step of transferring the toner image on a transfer medium. Examples of the transfer medium in the transferring step include a recording medium such as an intermediate transfer member and a sheet.

In the fixing step, exemplary methods include a method of fixing the toner image transferred on the transfer sheet and forming a copy image by means of a heated roller fixing device in which the temperature of the heated roller is set to a fixed temperature.

It is preferable that the image forming method according to the exemplary embodiment include a cleaning step of cleaning the developer remaining on the image holding member using a cleaning unit.

It is preferable that the cleaning step include a step of removing the electrostatic charge image developer remaining on the image holding member using a cleaning blade.

Preferable examples of the material of the cleaning blade be a urethane rubber, a neoprene rubber, a silicone rubber, or the like.

It is possible to use a known medium as the recording medium, and examples thereof include a sheet used in an electrophotography method copying machine, a printer or the like, and OHP sheets, and it is possible to favorably use a coated sheet in which the surface of an plain paper is coated with a resin or the like, an art sheet for printing or the like.

The image forming method according to the exemplary embodiment may be an aspect which further includes a recycling step. The recycling step is a step in which the electrostatic charge image developing toner collected in the cleaning step is moved to the developer layer. The image forming method of the aspect which includes a recycling step is carried out using an image forming apparatus such as a toner recycling system type copying machine, a facsimile machine or the like. The cleaning step may be omitted, and the recycling step may be applied to a recycling system having an aspect that collects the toner at the same time as the developing.

(4) Image Forming Apparatus

Although the image forming apparatus according to the exemplary embodiment may include a developing unit which causes the electrostatic latent image to be developed using the electrostatic charge image developer according to the exemplary embodiment and a toner image to be formed, it is preferable that the device include an image holding member, a charging unit which causes the image holding member to be charged, an exposure unit which causes the charged image holding member to be exposed and an electrostatic latent image to be formed on the surface of the image holding member, and a developing unit which causes the electrostatic latent image to be developed using a developer which includes a toner, and a toner image to be formed, a transfer unit which transfers the toner image from the image holding member to the surface of a transfer medium, and a fixing unit which fixes the toner image transferred to the surface of the transfer medium, and that the toner be the electrostatic charge image developing toner according to the exemplary embodiment or the developer be the electrostatic charge image developer according to the exemplary embodiment.

It is preferable that the image forming apparatus according to the exemplary embodiment include a cleaning unit which cleans the image holding member with a cleaning blade.

The FIGURE is a schematic configuration diagram illustrating a 4-unit tandem-type color image forming apparatus. The image forming apparatus illustrated in the FIGURE is provided with electrophotographic-type first to fourth image forming units 10Y, 10M, 10C, and 10K (image forming unit) which output each of yellow (Y), magenta (M), cyan (C), and black (K) based on image data separated by color. The image forming units (below, may also simply be referred to as "unit") 10Y, 10M, 10C, and 10K are arranged in parallel in the horizontal direction separated from one another only by a predetermined distance. The units 10Y, 10M, 10C, and 10K may be process cartridges that are detachable from the image forming apparatus.

In the upper portion of the drawings of each unit 10Y, 10M, 10C and 10K, an intermediate transfer belts 20 is provided as an intermediate transfer member passing through each unit. The intermediate transfer belt 20 is provided wrapped on a support roller 24 which contacts the inner surface of a driving roller 22 and the intermediate transfer belt 20 arranged separated from each other in the left-to-right direction in the drawing, and travels in a direction from the first unit 10Y towards the fourth unit 10K. The support roller 24 applies a force in the direction separating from the driving roller 22 by a spring or the like, not shown, and applies a tension to the intermediate transfer belt 20 wrapped around both rollers. The cleaning unit 30 of the intermediate transfer member is provided facing the driving roller 22 on the side surface of the image holding member of the intermediate transfer belt 20. Four colors of toner having yellow, magenta, cyan, and black contained in the toner cartridges 8Y, 8M, 8C, and 8K are able to be provided to the developing devices (developing unit) 4Y, 4M, 4C, and 4K, respectively, of each unit 10Y, 10M, 10C, and 10K.

Because the above-described first to fourth units 10Y, 10M, 10C, and 10K have the same configuration, description will be provided herein with the first unit 10Y which forms a yellow image arranged on the upstream side in the traveling direction intermediate transfer belt as a representative. It should be noted that applying reference numerals with magenta (M), cyan (C), and black (K) appended instead of yellow (Y) to the equivalent portions to the first unit 10Y, description of the second to fourth units 10M, 10C, and 10K will not be provided.

The first unit 10Y includes a photoreceptor 1Y which acts as an image holding member (photoreceptor). A charging roller (charging device, charging unit) 2Y which causes surface of the photoreceptor 1Y to be charged to a predetermined potential, an exposure device (exposure unit) 3 which exposes the charged surface with a laser beam 3Y based on an image signal separated by color and forms an electrostatic charge image, a developing device (developing unit) 4Y which supplies the charged toner to the electrostatic charge image and develops the electrostatic charge image, a primary transfer roller (primary transfer unit) 5Y which transfers the developed toner image on the intermediate transfer belt 20, and a cleaning device (cleaning unit) 6Y which removes toner remaining on the surface of the photoreceptor 1Y after the primary transfer using a cleaning blade are disposed in this order on the periphery of the photoreceptor 1Y.

The primary transfer roller 5Y is arranged on the inside of the intermediate transfer member 20, and provided at a position facing the photoreceptor 1Y. Each primary transfer roller 5Y, 5M, 5C, and 5K is connected to a respective bias power source (not shown) which applies a primary transfer bias. Each bias power source varies the transfer bias applied to each primary transfer roller according to control by a controller, not shown.

Below, the operation of forming a yellow image in the first unit 10Y will be described. First, the surface of the photoreceptor 1Y is charged by the charging roller 2Y in advance of the operation. A laser beam 3Y is output via the exposure device 3 to the surface of the charged photoreceptor 1Y according to the yellow image data sent from the controller, not shown. The laser beam 3Y radiated on the photosensitive layer of the surface of the photoreceptor 1Y, and electrostatic charge image of a yellow printing pattern is formed on the surface of the photoreceptor 1Y. The electrostatic charge image formed on the photoreceptor 1Y in this way is rotated as far as a predetermined developing position according to the traveling of the photoreceptor 1Y. The electrostatic charge image on the photoreceptor 1Y is made a visible image (developed image, toner image) by the developing device 4Y at the developing position.

The electrostatic charge image developer which includes at least the yellow toner and the carrier according to the exemplary embodiment is contained in the developing device 4Y. By the surface of the photoreceptor 1Y passing through the developing device 4Y, the yellow toner is electrostatically attached to the erased electrostatic image portion on the surface of the photoreceptor 1Y, and the latent image is developed by the yellow toner. The photoreceptor 1Y on which the yellow toner image is formed continuously travels at a predetermined speed, and the toner image developed on the photoreceptor 1Y is transported to a predetermined primary transfer position.

When the yellow toner image on the photoreceptor 1Y is transported to the primary transfer, the primary transfer bias is applied to the primary transfer roller 5Y, the static electricity acts on the toner image from the photoreceptor 1Y towards the primary transfer roller 5Y, and the toner image on the photoreceptor 1Y is transferred onto the intermediate transfer belt 20. Meanwhile, the toner remaining on the photoreceptor 1Y is removed and collected by a cleaning device 6Y which includes a cleaning blade.

The primary transfer bias applied to the primary transfer rollers 5M, 5C, and 5K subsequent to the second unit 10M is also controlled based on the first unit. Thereby, the intermediate transfer belt 20 on which the yellow toner image is transferred by the first unit 10Y is sequentially transported through the second to fourth units 10M, 10C, and 10K, and each color of toner image is overlapped, thereby being multiply transferred.

The intermediate transfer belt 20 on which the four colors of toner image are multiply transferred through the first to fourth units reaches the secondary transfer unit formed of the intermediate transfer belt 20, support roller 24 which contacts the inner surface of the intermediate transfer belt, and a secondary transfer roller (secondary transfer unit) 26 which is disposed on the image holding surface side of the intermediate transfer belt 20. Meanwhile, the recording sheet (transfer medium) P is supplied via a supply mechanism at a predetermined timing in the gap in which the secondary transfer roller 26 and the intermediate transfer belt 20 are pressed, the secondary transfer bias is applied to the support roller 24, and the toner image on the intermediate transfer belt 20 is transferred onto the recording sheet P.

Thereafter, the recording sheet P is sent to the nip portion with a pair of fixing rolls in the fixing device (roll-shaped fixing unit) 28, the toner image is heated, the toner image in which the colors are overlapped is melted and fixed onto the recording sheet P. The recording sheet P in which the fixing of the color image is completed is transported towards a discharge unit, and the series of color image forming operations is completed.

Although the image forming apparatus according to the exemplary embodiment is not particularly limited as long as the device includes at least the above-described image holding member, charging unit, exposure unit, developing unit, and transfer unit, the image forming device may include a fixing unit, erasing unit, cleaning unit and the like along therewith, as necessary.

The transfer unit may perform two or more transfers using the intermediate transfer member. Examples of the transfer medium in the transfer unit include a recording medium such as an intermediate transfer member and a sheet.

It is possible for a configuration described by the image holding member and each unit, and each step in the image forming method to be preferably used. It is possible to use well-known units in any image forming apparatus as each of the above units. The image forming apparatus according to the exemplary embodiment may include units, devices, and the like other than the above-described configurations. The image forming apparatus according to the exemplary embodiment may perform operations using the plural units at the same time.

It is preferable that the image forming apparatus according to the exemplary embodiment be provided with a cleaning unit that removes the electrostatic charge image developer remaining on the image holding member with a cleaning blade.

(5) Toner Cartridge, Developer Cartridge, and Process Cartridge

The toner cartridge according to the exemplary embodiment is a toner cartridge that contains at least the electrostatic charge image developing toner according to the exemplary embodiment.

The developer cartridge according to the exemplary embodiment is a developer cartridge that contains at least the electrostatic charge image developer according to the exemplary embodiment.

The process cartridge according to the exemplary embodiment is provided with at least one selected from the group consisting of a developing unit which develops the electrostatic latent image formed on the surface of the image holding member using the electrostatic charge image developing toner or electrostatic charge image developer and forms a toner image, an image holding member, a charging unit for causing the surface of the image holding member to be charged, and a cleaning unit for removing toner remaining on the surface of the image holding member, and contains at least the electrostatic charge image developing toner according to the exemplary embodiment or the electrostatic charge image developer according to the exemplary embodiment.

It is preferable that the toner cartridge according to the exemplary embodiment be detachable from the image forming apparatus. That is, the toner cartridge according to the exemplary embodiment in which the toner according to the exemplary embodiment is stored is suitably used in an image forming apparatus in which the toner cartridge has a detachable configuration. The toner cartridge according to the exemplary embodiment may have a container which contains the toner according to the exemplary embodiment.

As long as the developer cartridge according to the exemplary embodiment contains the electrostatic charge image developer which includes the electrostatic charge image developing toner according to the exemplary embodiment, there is no particular limitation on the developer cartridge. The developer cartridge is detached from the image forming apparatus provided with the developing unit and stores the electrostatic charge image developer which includes the electrostatic charge image developing toner according to the exemplary embodiment as the developer to be provided to the developing unit.

The developer cartridge may be a cartridge that stores the toner and the carrier, or the cartridge which independently stores the toner and the cartridge which independently stores the carrier may be separate members.

It is preferable that the process cartridge according to the exemplary embodiment be detachable from the image forming apparatus.

The process cartridge according to the exemplary embodiment may include other members such as an erasing unit, as necessary.

Well-known configurations may be employed as the toner cartridge and the process cartridge.

EXAMPLES

Below, the Examples and Comparative Examples are provided, and although the exemplary embodiment is described in more specific detail, the exemplary embodiment is not limited to the following examples. Unless otherwise specified, the terms "parts" and "%" indicate "parts by weight" and "weight %".

<Preparation of Polyester Resin A>

4.2 mol % ethylene glycol, 10.0 mol % propylene glycol, 12.0 mol % terephthalic acid, 3.0 mol % trimellitic acid, and 0.9 parts by weight of tetraisopropoxytitanium-bisdioctyl phosphite as a catalyst with respect to 100 parts by weight of the total weight of the monomers are reacted under pressure while being stirred at 245° C. under a nitrogen gas flow. The degree of polymerization is followed by the softening point, the reaction is completed at the time when the softening point reaches 140° C. The obtained resin is designated as polyester resin A. It should be noted that the polyester resin A is a resin in which the amount of aliphatic alcohol in the total alcohol components becomes 100 mol %.

<Preparation of Polyester Resin B>

4.2 mol % propylene oxide adduct of bisphenol A (average number of added mols: 2.2 mols), 10.0 mol % propylene glycol, 12.0 mol % terephthalic acid, 3.0 mol % trimellitic acid, and 0.9 parts by weight of tetraisopropoxytitanium-bisdioctyl phosphite as a catalyst with respect to 100 parts by weight of the total weight of the monomers are reacted under pressure while being stirred at 245° C. under a nitrogen gas flow. The degree of polymerization is followed by the softening point, the reaction is completed at the time when the softening point reaches 140° C. The obtained resin is designated as polyester resin B. The polyester resin B is a resin in which the amount of propylene oxide adducts of bisphenol A is 30 mol % and the amount of aliphatic alcohol is 70 mol % in the total alcohol components.

<Preparation of Polyester Resin C>

7.1 mol % propylene oxide adduct of bisphenol A (average number of added moles: 2.2 mols), 7.1 mol % propylene glycol, 12.0 mol % terephthalic acid, 3.0 mol % trimellitic acid, and 0.9 parts by weight of tetraisopropoxytitanium-bisdioctyl phosphite as a catalyst with respect to 100 parts by weight of the total weight of the monomer are reacted under pressure while being stirred at 245° C. under a nitrogen gas flow. The degree of polymerization is followed by the softening point, the reaction is completed at the time when the softening point reaches 140° C. The obtained resin is designated as polyester resin C. The polyester resin C is a resin in which the amount of propylene oxide adducts of bisphenol A is 50 mol % and the amount of aliphatic alcohol is 50 mol % in the total alcohol components.

<Preparation of Polyester Resin D>

4.2 mol % propylene oxide adduct of bisphenol A (average number of added mols: 2.2 mols), 10.0 mol % ethylene oxide adduct of bisphenol A (average number of added mols: 2.2 mols), 12.0 mol % terephthalic acid, 3.0 mol % trimellitic acid, and 0.9 parts by weight of tetraisopropoxytitanium-bisdioctyl phosphite as a catalyst with respect to 100 parts by weight of the total weight of the monomers are reacted under pressure while being stirred at 245° C. under a nitrogen gas flow. The degree of polymerization is followed by the softening point, the reaction is completed at the time when the softening point reaches 140° C. The obtained resin is designated as polyester resin D. The polyester resin D is a resin in which the amount of propylene oxide adducts of bisphenol A is 100 mol % and the amount of aliphatic alcohol is 0 mol % in the total alcohol components.

<Preparation of Cyclic Carbodiimide>

—Preparation of Cyclic Carbodiimide-1— o-nitrophenol (0.11 mol), 1,4-bis(bromomethyl)benzene (0.05 mol), potassium carbonate (0.33 mol) and 200 ml of N,N-dimethyl formamide (DMF) are incorporated in a $N_2$ atmosphere in a reaction device in which a stirring device and a heating device are installed, the DMF is removed under reduced pressure after being reacted for 12 hours at 130° C., the obtained solid content is dissolved in 200 ml of dichloromethane, and separated three times with 100 ml of water. The organic layer is dehydrated with 5 g of sodium sulfate, and the dichloromethane is removed under reduced pressure, thereby obtaining the intermediate product A (nitro material).

Next, the intermediate product A (0.1 mol), 5% palladium carbon (Pd/C) (1.5 g), 300 ml of ethanol/dichloromethane (70/30) are incorporated in a reaction device in which a stirring device is installed, hydrogen replacement carried out five times, and reacted in a state in which hydrogen is constantly supplied at 25° C., and the reaction finishes when the reduction of the hydrogen is eliminated. When the Pd/C is collected, and the mixed solvent is removed, the intermediate product B (amine material) is obtained.

Next, triphenylphosphine dibromide (0.11 mol) and 150 ml of 1,2-dichloromethane are incorporated and stirred in a $N_2$ atmosphere in a reaction device in which a stirring device, a heating device and a dropping route are installed, and a solution in which the intermediate product B (0.05 mol) and triethylamine (0.25 mol) are dissolved in 50 ml of 1,2-dichloroethane is slowly added dropwise thereto at 25° C. After the completion of dropwise addition, the reaction is further allowed to proceed at 70° C. for 5 hours. Thereafter, the reaction solution is filtered and the filtered solution is separated five times with 100 ml of water. The organic layer is dehydrated with 5 g of sodium sulfate, and the 1,2-dichloroethane is removed under reduced pressure, thereby obtaining the intermediate product C (triphenyl phosphine material).

Next, di-tert-butyldicarbonate (0.11 mol), N,N-dimethyl-4-aminopyridine (0.055 mol), and 150 ml of dichloromethane are incorporated and stirred in a $N_2$ atmosphere in a reaction device in which a stirring device and a dropping route are installed, and 100 ml of dichloromethane in which the intermediate product C (0.05 mol) is dissolved at 25° C. is slowly added thereto. After the dropwise addition, the reaction is carried out for 12 hours. Thereafter, the cyclic carbodiimide-1 (molecular weight 328) indicated below is obtained by purifying obtained solid content from which the dichloromethane is removed.

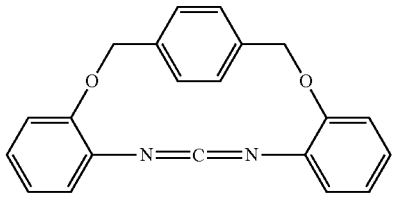

—Preparation of Cyclic Carbodiimide-2— o-nitrophenol (0.11 mol), 1,2-dibromoethane (0.05 mol), potassium carbonate (0.33 mol), and 200 ml of N,N-dimethyl formamide are incorporated in a $N_2$ atmosphere in a reaction device in which a stirring device and a heating device are installed, the DMF is removed under reduced pressure after being reacted for 12 hours at 130° C., the obtained solid content is dissolved in 200 ml of dichloromethane, and separated three times with 100 ml of water. The organic layer is dehydrated with 5 g of sodium sulfate, and the dichloromethane is removed under reduced pressure, thereby obtaining the intermediate product A (nitro material).

Next, the intermediate product A (0.1 mol), 5% palladium carbon (Pd/C) (1 g), 200 ml of ethanol/dichloromethane (70/30) are incorporated in a reaction device in which a stirring device is installed, hydrogen replacement carried out five times, and reacted in a state in which hydrogen is constantly supplied at 25° C., and the reaction finishes when the reduction of the hydrogen is eliminated. When the Pd/C is collected, and the mixed solvent is removed, the intermediate product B (amine material) is obtained.

Next, triphenylphosphine dibromide (0.11 mol) and 150 ml of 1,2-dichloromethane are incorporated and stirred in a $N_2$ atmosphere in a reaction device in which a stirring device, a heating device, and a dropping route are installed, and a solution in which the intermediate product B (0.05 mol) and triethylamine (0.25 mol) are dissolved in 50 ml of 1,2-dichloroethane is slowly added dropwise thereto at 25° C. After the completion of dropwise addition, the reaction is further allowed to proceed at 70° C. for 5 hours. Thereafter, the reaction solution is filtered and the filtered solution is separated five times with 100 ml of water. The organic layer is dehydrated with 5 g of sodium sulfate, and the 1,2-dichloroethane is removed under reduced pressure, thereby obtaining the intermediate product C (triphenyl phosphine material).

Next, di-tert-butyldicarbonate (0.11 mol), N,N-dimethyl-4-aminopyridine (0.055 mol), and 150 ml of dichloromethane are incorporated and stirred in a $N_2$ atmosphere in a reaction device having a stirring device and a dropping route installed, and 100 ml of dichloromethane in which the intermediate product C (0.05 mol) is dissolved at 25° C. is slowly added thereto. After the dropwise addition, the reaction is carried out for 12 hours. Thereafter, dichloromethane is removed therefrom and the resultant solid content is purified to thereby obtain a cyclic carbodiimide-2 (molecular weight 252) indicated below.

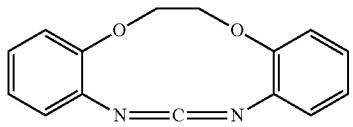

<Preparation of Toner A>

85 parts by weight of the polyester resin A, 10 parts by weight of carbon black (#25, manufactured by MITSUBISHI CHEMICAL CORPORATION), 4 parts by weight of paraffin wax (HNP-9, manufactured by NIPPON SEIRO CO., LTD), 1 part by weight of the linear carbodiimide (HMV-15CA, manufactured by NISSHINBO CHEMICAL INC.) are mixed and molten-kneaded at 150° C. and 200 rpm using an extruder (PCM-30 manufactured by IKEGAI CORP.), thereby obtaining a kneaded product. Next, after the kneaded product is coarsely pulverized in a hammer mill, and finely pulverized in a jet mill, the resultant is classified with an airflow classifier, thereby obtaining toner mother particles having a volume average particle diameter of 5.5 μm. One part of hydrophobic silica particles (H2000/4, manufactured by CLARIANT) with respect to 100 parts of the toner particles are subjected to external addition processing with a HENSCHEL MIXER, thereby obtaining the toner A.

<Preparation of Toner B to L>

Based on the compositions disclosed in the following Table 1, the toners B to L are prepared in the same manner as in the preparation of the toner A.

<Preparation of Carrier>

—Formation of Core—

23.0% by weight of MnO, 3.5% by weight of MgO, 73.0% by weight of $Fe_2O_3$, and 0.5% by weight of SrO are mixed, and after mixing/pulverizing for 10 hours in a wet-type ball mill, the resultant is dried, and thereafter kept at 950° C. for 4 hours to perform preliminary baking.

The obtained preliminarily baked product is pulverized for 24 hours in a wet-type ball mill, and next after granulating and drying with a spray dryer, and the resultant is kept at 1,250° C. for 6 hours in an atmosphere with a 99% nitrogen density in an electric furnace to perform main baking.

The obtained main baked product is crushed, and further classified to obtain the core of the ferrite particles.

The obtained ferrite particle cores have an average particle diameter of 24 μm, and the saturation magnetization when the applied magnetic field is 10 kOersted is 73 $A \cdot m^2/kg$.

—Preparation of Coating Layer Coating Solution—

200 parts of toluene, and 30 parts of a styrene-methyl methacrylate copolymer (compositional ratio 30:70 (weight ratio), weight average molecular weight 210,000) are stirred with a stirrer for 60 minutes and thus, a resin coating solution is obtained. 100 parts of the resin coating solution, and 1.57 parts of carbon black (trade name: KETJEN BLACK EC600JD, BET specific surface area 1,270 $m^2/g$, manufactured by LION) are stirred for 10 minutes at 5,000 rpm using a homogenizer (ULTRA-TURRAX, manufactured by IKA), thereby obtaining a dispersion.

—Formation of Coating Layer—

The coating layer coating solution is charged into a fluid bed coating device (SPIR-A-FLOW, manufactured by FREUND CORP.) in such an amount to provide 250 parts by weight of the solid content to 10,000 parts by weight of the ferrite particles, and coating is performed for 30 minutes. Thereafter, drying is performed at 60° C., and thus, the coating carrier is obtained.

The average particle diameter of the coating carrier is 26 μm.

<Preparation of Electrostatic Charge Image Developer>

After 100 parts of the coated carrier and 10 parts of the toner disclosed in Table 1 are stirred for 20 minutes at 40 rpm with a V blender, the resultant is passed through a sieve with a mesh opening of 106 μm, and thus, the developers of Examples 1 to 8 and Comparative Examples 1 to 4 are each obtained.

<Evaluation Method>

A FUJI-XEROX DocuPrint P218b (24 ppm) which employs a two-component contact developing system is used in the following evaluation.

—Evaluation of Charging Amount—

The developer is taken out from the evaluation device and the charging amount of the developer is measured with a blow-off measurement device manufactured by TOSHIBA CHEMICAL CORP. The conditions of the blow-off charging amount measurement device are a blowing pressure of 1 $kg/cm^2$, a used metal mesh of 300 m stainless steel (SUS) mesh, and a measurement time of 20 seconds, and the charging amount is obtained at the maximum value over the 20 second measurement time.

—Evaluation of Printing Density—

The obtained developer is used, and measured by normal printing on a plain paper (75 $g/m^2$) for a copying machine.

For the image density, the relative density to a white background print out image in which the original document density is 0.00 is measured using a "MACBETH REFLECTION DENSITOMETER" (manufactured by GRETAG-MACBETH GMBH).

A: Value of Δ of 0.02 or less
B: Value of Δ of more than 0.02 to 0.12
C: Value of Δ of more than 0.12 to 0.15
D: Value of Δ of more than 0.16

—Evaluation of Fixability—

A plain paper is used as the recording medium, and a one square inch (2.54 cm×2.54 cm) image is formed by the image forming apparatus. Specifically, image printout is performed while adjusting the application amount of the toner (toner applied amount on the recording medium) to be 0.5 mg/cm$^2$, and the fixing temperature is 145° C.

Next, the fixing rate of the obtained one square inch image is measured as follows. First, the status A density (OD1) is measured for each color of the image, and, thereafter, an adhesive tape (SCOTCH MENDING TAPE, manufactured by SUMITOMO 3M LIMITED) was adhered to the image, then, the adhesive table is peeled off, and the status A density (OD2) of the image after peeling is measured. For the measurement of the optical density, X-RITE 938 is used. Next, the fixing rate is calculated with the following equation (T) using the obtained optical density value.

$$\text{Fixing rate}(\%)=(OD2/OD1)\times 100 \qquad \text{Equation (T)}$$

The evaluation of the fixability is evaluated by the following evaluation criteria in the fixing rate calculated equation (T).

A: Fixing rate of 95% or more
B: Fixing rate of from 90% to less than 95%
C: Fixing rate of from 80% to less than 90%
D: Fixing rate of less than 80%

The evaluation results are collectively shown in Table 1.

TABLE 1

| | | Example 1 Toner A | Example 2 Toner B | Comparative Example 1 Toner C | Example 3 Toner D | Example 4 Toner E | Example 5 Toner F | Example 6 Toner G | Example 7 Toner H | Example 8 Toner I | Comparative Example 2 Toner J | Comparative Example 3 Toner K | Comparative Example 4 Toner L |
|---|---|---|---|---|---|---|---|---|---|---|---|---|---|
| Polyester Resin A | | 85 | 85 | 86 | 85.95 | 85.5 | 81 | 79 | 85 | — | — | — | — |
| Polyester Resin B | | — | — | — | — | — | — | — | — | 85 | — | — | — |
| Polyester Resin C | | — | — | — | — | — | — | — | — | — | 85 | — | — |
| Polyester Resin D | | — | — | — | — | — | — | — | — | — | — | 85 | 86 |
| Carbon Black | | 10 | 10 | 10 | 10 | 10 | 10 | 10 | 10 | 10 | 10 | 10 | 10 |
| Paraffin Wax | | 4 | 4 | 4 | 4 | 4 | 4 | 4 | 4 | 4 | 4 | 4 | 4 |
| Linear Carbodiimide | | 1 | — | — | — | — | — | — | — | — | — | — | — |
| Cyclic Carbodiimide-1 | | — | 1 | — | 0.05 | 0.5 | 5 | 7 | — | 1 | 1 | 1 | — |
| Cyclic Carbodiimide-2 | | — | — | — | — | — | — | — | 1 | — | — | — | — |
| Silica Particles | | 1 | 1 | 1 | 1 | 1 | 1 | 1 | 1 | 1 | 1 | 1 | 1 |
| Total (parts by weight) | | 101 | 101 | 101 | 101 | 101 | 101 | 101 | 101 | 101 | 101 | 101 | 101 |
| Charge Amount (−μC/g) | Initial | 23.6 | 22.5 | 24.3 | 23.9 | 23.5 | 20.9 | 20.1 | 22.4 | 22.6 | 22.5 | 22.6 | 23.6 |
| | After printing 100,000 sheets | 37.2 | 24.5 | 45.5 | 29.5 | 25.5 | 23.2 | 22.1 | 34.5 | 24.3 | 24.1 | 23.5 | 30.9 |
| | Δ (difference between above values) | 13.6 | 2.0 | 21.2 | 5.6 | 2.0 | 2.3 | 2.0 | 12.1 | 1.7 | 1.6 | 0.9 | 7.3 |
| Printing Density | Initial | 1.31 | 1.33 | 1.31 | 1.31 | 1.32 | 1.34 | 1.35 | 1.33 | 1.32 | 1.33 | 1.32 | 1.31 |
| | After printing 100,000 sheets | 1.18 | 1.31 | 1.10 | 1.26 | 1.30 | 1.32 | 1.33 | 1.21 | 1.31 | 1.31 | 1.32 | 1.24 |
| | Δ (difference between above values) | 0.14 | 0.02 | 0.21 | 0.05 | 0.02 | 0.02 | 0.02 | 0.12 | 0.01 | 0.02 | 0.00 | 0.07 |
| | Evaluation | C | A | D | B | A | A | A | B | A | A | A | B |
| Fixability (120° C.) | | A | A | A | A | A | B | C | A | B | D | D | D |

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An electrostatic charge image developing toner, comprising:

a cyclic carbodiimide compound; and a polyester resin prepared by subjecting an alcohol component and a carboxylic acid component to condensation polymerization, wherein the alcohol component includes an aliphatic polyol in an amount of 60 mol % to 100 mol %.

2. The electrostatic charge image developing toner according to claim 1, wherein a content of the cyclic carbodiimide compound is from 0.1 parts by weight to 5 parts by weight with respect to 100 parts by weight of the polyester resin.

3. The electrostatic charge image developing toner according to claim 1, wherein the cyclic carbodiimide compound is a compound represented by the following formula (1):

(1)

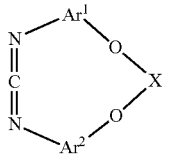

wherein X represents a bivalent group, and $Ar^1$ and $Ar^2$ each independently represent a bivalent aromatic group.

4. The electrostatic charge image developing toner according to claim 3, wherein X is a group represented by the following formula (2):

(2)

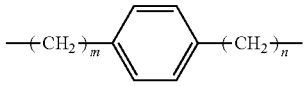

wherein m and n each independently represent an integer of 0 to 3.

5. The electrostatic charge image developing toner according to claim 1, wherein the cyclic carboxylic acid component includes an aromatic polyvalent carboxylic acid compound, and the aliphatic polyol includes at least one of ethylene glycol and propylene glycol.

6. The electrostatic charge image developing toner according to claim 1, wherein an acid value of the polyester resin is from 5 mgKOH/g to 70 mgKOH/g.

7. The electrostatic charge image developing toner according to claim 1, which has a shape coefficient SF1 of from 110 to 140.

8. An electrostatic charge image developer, comprising:

the electrostatic charge image developing toner according to claim 1; and a carrier.

9. A toner cartridge comprising:

a container that contains the electrostatic charge image developing toner according to claim 1, wherein the toner cartridge is detachable from an image forming apparatus.

* * * * *